US006318478B1

(12) United States Patent
Kaneko

(10) Patent No.: US 6,318,478 B1
(45) Date of Patent: Nov. 20, 2001

(54) DAMPER PRESSURE CONTROL APPARATUS FOR HYDRAULIC ROCK DRILL

(75) Inventor: Tsutomu Kaneko, Takasaki (JP)

(73) Assignee: Furukawa Co., Ltd. (JP)

( * ) Notice: Subject to any disclaimer, the term of this patent is extended or adjusted under 35 U.S.C. 154(b) by 0 days.

(21) Appl. No.: 09/780,327

(22) Filed: Feb. 9, 2001

(30) Foreign Application Priority Data

Jun. 1, 2000 (JP) ..... 12-165128

(51) Int. Cl.[7] ..... B25D 17/24

(52) U.S. Cl. ..... 173/4; 173/9; 173/135; 173/210; 173/212

(58) Field of Search ..... 173/2, 4, 9, 11, 173/135, 210, 211, 212, 105

(56) References Cited

U.S. PATENT DOCUMENTS 4,068,727 * 1/1978 Anderson et al. ..... 173/212
4,222,462 * 9/1980 Ottestad ..... 173/210
4,703,838 * 11/1987 Roussin et al. ..... 173/210
5,131,475 * 7/1992 Beney ..... 173/4
5,437,339 * 8/1995 Tanaka ..... 173/210
5,479,996 * 1/1996 Jonsson et al. ..... 173/212
5,771,981 * 6/1998 Briggs et al. ..... 173/4
5,896,937 4/1999 Kaneko .

FOREIGN PATENT DOCUMENTS

WO00/39490 12/1999 (JP) .

* cited by examiner

*Primary Examiner*—Scott A. Smith
(74) *Attorney, Agent, or Firm*—Young & Basile, P.C.

(57) ABSTRACT

A damper pressure control apparatus for a hydraulic rock drill is automatically adjustable of damper pressure to be applied to a damping piston depending upon a thrust of a rock drill body and makes damping function and floating function effective even when thrust of hydraulic rock drill is varied. The damper control apparatus is thus provides a damper pressure control for controlling the damper pressure (DPpr) to be applied to a damping piston (16, 17) from a hydraulic pressure source (21) based on the frontward thrust (F1) acting on the hydraulic rock drill body 1.

1 Claim, 9 Drawing Sheets

DAMPER PRESSURE CONTROL APPARATUS FOR HYDRAULIC ROCK DRILL

BACKGROUND OF THE INVENTION

1. Field of the Invention

The present invention relates to a damper pressure control apparatus for a hydraulic rock drill for crushing a rock or the like by striking a tool, such as a rod, chisel or the like.

2. Description of the Related Art

As shown in FIG. 8, in which is illustrated one of typical conventional hydraulic rock drills, a shank rod 102 is mounted at the front end of a hydraulic rock drill body 101. A hole boring bit 106 is mounted on the front end of a rod 104 via a sleeve 105. When a striking piston 107 of a striking mechanism 103 of the hydraulic rock drill strikes the shank rod 102, a striking energy is transmitted to the bit 106 from the shank rod 102 via the rod 104. Then, the bit 106 strikes a rock R to crush.

At this time, a reaction energy Er from the rock R is transmitted to the hydraulic rock drill body 101 from the bit 106 via the rod 104 and the shank rod 102. By the reaction energy Er, the hydraulic rock drill body 101 is driven backward once. Then, the hydraulic rock drill body 101 is propelled by a thrust of a feeding device (not shown) for a crushing length in one strike from a position before striking. Then, at the advanced position, next strike is performed by the striking mechanism 103. By repeating these steps, hole boring operation is performed.

Then, as a damping mechanism of the rock drill, namely a mechanism for damping the reaction energy Er, there have been developed a mechanism employing a two stage damping piston having a function for hydraulically damping the reaction energy Er and a function for improving striking transmission efficiency (dual damper type), and a mechanism employing a single damping piston which is not mechanically fixed the position thereof (floating type).

In FIG. 9 the hydraulic rock drill employing the two stage damping piston is provided with a chuck driver 109 applying rotation for the shank rod 102 via a chuck 108. For the chuck driver 109, a chuck driver bushing 110 is fitted as a transmission member contacting with a large diameter rear end 102*a* of the shank rod 102. Then, on the backside of the chuck driver bushing 110, a front damping piston 111 and a rear damping piston 112 are arranged as a damping mechanism.

The rear damping piston 112 is a cylindrical piston having a fluid passage 113 communicating outside and inside thereof. The rear damping piston 112 is slidably mounted between a central step portion 101*c* and a rear step portion 101*b* provided in the hydraulic rock drill body 101. The rear damping piston 112 is applied a frontward thrust by a hydraulic pressure in a fluid chamber 114 for the rear damping piston. On the other hand, the front damping piston 111 is a cylindrical piston having a small external diameter at the rear portion. The small diameter portion of the front damping piston 111 is inserted within the rear damping piston 112 in longitudinally slidable fashion. By a large diameter portion, the front damping piston 111 is restricted a longitudinal motion range between a front side step portion 101*a* of the hydraulic rock drill body 101 and a front end face 112*a* of the rear damping piston 112. Between an outer periphery of the small diameter portion of the front damping piston 111 and an inner periphery of the rear damping piston 112, a fluid chamber 115 for the front damping piston is defined for applying a frontward thrust to the front damping piston 111.

The fluid chamber 115 for the front damping piston and the fluid chamber 114 for the rear damping piston are communicated through a fluid passage 113. The fluid chamber 114 of the rear damping piston is communicated with a hydraulic pressure source 116. A hydraulic pressure from the hydraulic pressure source 116 is fixed at a given pressure by a relief valve or pressure reduction valve (not shown). To the front damping piston 111, a given thrust F111 derived as a product of a pressure receiving area and a hydraulic pressure in the fluid chamber 115 of the front damping piston, acts. Similarly, to the rear damping piston 112, a given thrust F112 derived as a product of a pressure receiving area and a hydraulic pressure in the fluid chamber 114 for the rear damping piston, acts.

On the other hand, to the hydraulic rock drill body 101, a frontward thrust F101 is constantly applied. This thrust is transmitted to the front damping piston 111 and the rear damping piston 112 as reaction force from the rock R via the bit 106, the rod 104, the shank rod 102 and the chuck driver bushing 110.

Here, the thrust F111 acting on the front damping piston 111 and the thrust F112 acting on the rear damping piston 112 are set relative to the thrust F101 acting on the hydraulic rock drill body 101 to establish a relationship F111<F101<F112. Therefore, before striking, the front damping piston 111 and the rear damping piston 112 contact with each other to stop at striking reference position (position shown in FIG. 9) where the front end face 112*a* of the rear damping piston 112 contacts with the central step portion 101*c* of the hydraulic rock drill body 101.

At the striking reference position, when the striking piston 107 of the striking mechanism 103 strikes the shank rod 102, the striking energy is transmitted from the shank rod 102 to the bit 106 via the rod 104. Then, the bit 106 strikes the rock R as crushing object. At this time, the reaction energy Er from the rock R is transmitted to the front damping piston 111 and the rear damping piston 112 from the bit 106 via the rod 104, the shank rod 102 and the chuck driver bushing 110. Then, the rear damping piston 112 is retracted until contacting the rear end face with a rear step portion 101*b* together with the front damping piston 111 with damping by the thrust F112. Thus, the reaction energy Er is transmitted to the hydraulic rock drill body 101. Accordingly, the rear damping piston 112 performs damping function of the reaction energy Er, namely impact force absorbing function. Also, the thrust acting on the rear damping piston 112 serves as damping force.

By the reaction energy Er transmitted to the hydraulic rock drill body 101, the main body 101 is driven backward once. Subsequently, the rear damping piston 112 is driven forward to stop at the striking reference position where the front end face 112*a* thereof abuts onto the central step portion 101*c* of the hydraulic rock drill body 101 by pushing back the front damping piston 111, the chuck driver bushing 110 and the shank rod 102 since the thrust F112 applied by the fluid pressure in the fluid chamber 114 for the rear damping piston is greater than the thrust F101 applied to the hydraulic rock drill body 101. At this condition, the next striking is awaited.

In the condition where contact between the bit 106 and the rock R is incomplete, the thrust F101 of the hydraulic rock drill body 101 is not sufficiently transmitted to the rock R. Therefore, a reaction force much smaller than the thrust F101 is transmitted to the rod 104, the sleeve 105, the shank rod 102, the chuck driver bushing 110 and the front damping piston 111 from the bit 106. Accordingly, the front damping piston 111 is moved away from the rear damping piston 112 by the thrust F111 to urge the bit 106 toward the rock R via the chuck driver bushing 110 and the shank rod 102 to advance the bit 106 before advancement of the hydraulic rock drill body 101 to prevent blank striking. Accordingly, the front damping piston 111 performs action for tightly contacting the tool, such as bit 106 or the like onto the rock R, namely, floating action. Then, the thrust F111 on the front damping piston 111 serves as floating force.

Subsequently, the hydraulic rock drill body 101 is advanced by the thrust F101. After contacting the bit 106 onto the rock R, since the thrust F101 of the hydraulic rock drill body 101 is greater than the thrust F111 of the front damping piston 111, the front damping piston 111 is pushed back until it comes in contact with the rear damping piston 112.

On the other hand, as shown in FIG. 10, in the case of a floating system using a single damping piston which is not mechanically fixed in position, the hydraulic rock drill body 101 is provided with a chuck driver 109 applying a rotational force of the shank rod 102 via the chuck 108. To the chuck driver 109, the chuck driver bushing 110 is mounted as a transmission member contacting with a large diameter rear end 102*a* of the shank rod 102. On the rear side of the chuck driver bushing 110, a damping piston 130 forming as damping mechanism is provided.

The damping piston 130 is a cylindrical piston which has large diameter portion 130*a* at front side and a small diameter portion 130*b* at rear side. Between the large diameter portion 130*a* and the small diameter portion 130*b*, a neck portion 130*c* having external diameter smaller than the small diameter portion 130*b* is provided. The damping piston 130 is slidably inserted within the hydraulic rock drill body 101 for longitudinal movement between a front step portion 101*a* and a rear step portion 101*b*.

Between an inner peripheral sliding surface of the hydraulic rock drill body 101 and the neck portion 130*c* of the damping piston 130, a hydraulic pressure chamber 131 is defined. The damping piston 130 is applied a forward thrust by the hydraulic pressure in the hydraulic pressure chamber 131. On the inner peripheral sliding surface of the hydraulic rock drill body 101, a drain passage 133 is defined at the front side of the hydraulic pressure chamber 131 at a position distant from the latter for a seal length S1, and a pressure supply passage 132 is defined at the rear side of the hydraulic pressure chamber 131 at a position distant from the latter for a seal length S2. The pressure supply passage 132 is communicated with a hydraulic pressure source 116.

A hydraulic pressure P2 applied to the damping piston 130 from the hydraulic pressure source 116 is fixed at a given pressure by a relief valve or a pressure reduction valve (not shown) similarly to the case when the two stage damping piston is used.

A pressurized fluid from the hydraulic pressure source 116 flows into the hydraulic pressure chamber 131 via the pressure supply passage 132 and the seal length S2 and is discharged to the drain passage 133 via the seal length S1. At this time, a pressure P1 as a difference between inflow amount and flow-out amount of the pressurized fluid is generated within the hydraulic pressure chamber 131. The pressure P1 of the hydraulic pressure chamber 131 is smaller than a hydraulic pressure P2 from the hydraulic power source 116, and thus P1<P2 is established.

The thrust F130 to be applied to the damping piston 130 is a product of a pressure receiving area of the hydraulic pressure chamber 131 and the pressure P1 and a thrust to be applied to the hydraulic rock drill body 101 by a known feeding mechanism is assumed as F101. The thrust F130 is set to be equal to the thrust F101 in the condition where the damping piston 130 is stopped at the striking reference position (position shown in FIG. 10).

When the damping piston 130 is retracted from the striking reference position, the seal length S2 is reduced to increase flow amount of the pressurized fluid flowing into the hydraulic pressure chamber 131 from the hydraulic pressure source 116 via the pressure supply passage 132, and conversely, the seal length S1 is increased to reduce flow amount of the pressurized fluid from the hydraulic pressure chamber 131 to the drain passage 133. By this, the hydraulic pressure P131 in the hydraulic pressure chamber 131 is increased to increase frontward thrust F130 applied to the damping piston 130.

Furthermore, when the damping piston 130 is driven backward to contact the rear end face 130*e* of the damping piston 130 onto the rear step portion 101*b*, the seal length S2 becomes smaller than or equal to 0. Then, all amount of the pressurized fluid from the hydraulic pressure source 116 flows into the hydraulic pressure chamber 131, and conversely, the seal length S1 is further increased to further reduce pressurized fluid flowing out to the drain passage 133. By this, the hydraulic pressure P1 in the hydraulic pressure chamber 131 is further increased. Therefore, forward thrust F130 to be applied to the damping piston 130 becomes maximum.

On the other hand, when the damping piston 130 is advanced from the striking reference position, the seal length S2 is increased to reduce the flow amount of the pressurized fluid flowing into the hydraulic pressure chamber 131 via the pressure supply passage 132, and conversely, the seal length S1 is reduced to increase flow amount flowing out from the hydraulic pressure chamber 131 to the drain passage 133. By this, the hydraulic pressure P1 in the hydraulic pressure chamber 131 is reduced to reduce the frontward thrust F130 to be applied to the damping piston 130.

When the damping piston 130 is further advanced to contact the front end face 130*d* onto the front step portion 101*a*, the seal length S1 becomes smaller than or equal to 0. Then, the hydraulic pressure chamber 131 and the drain passage 133 are communicated to further reduce the hydraulic pressure P1 in the hydraulic pressure chamber 131. Therefore, the forward thrust F130 to be applied to the damping piston 130 becomes minimum.

In the striking reference position, the striking piston 107 strikes the shank rod 102. Then, the striking energy is transmitted to the bit 106 from the shank rod 102 via the rod 104 to strike and crush the rock R as crushing object by the bit 106.

At this time, the reaction energy Er instantly generated from the rock R is transmitted to the damping piston 130 from the bit 106 via the shank rod 102 and the chuck driver bushing 110. The damping piston 130 is driven backward as being damped by the hydraulic pressure of the hydraulic pressure chamber 130. Then, the reaction energy Er is transmitted to the hydraulic rock drill body 101.

Accordingly, the damping piston 130 performs damping action of the reaction energy Er, namely impact force absorbing action. Then, the thrust F130 acting on the damping piston 130 serves as the damping thrust.

By the reaction energy Er transmitted to the hydraulic rock drill body 101, the hydraulic rock drill body 101 is driven backward once. Subsequently, the reaction force against the striking force is reduced. Then, the reaction force to act on the chuck driver bushing 110 becomes only reaction force of the thrust F101 to be applied to the hydraulic rock drill body 101. On the other hand, associating with backward motion of the damping piston 130, the hydraulic pressure P1 in the hydraulic pressure chamber 131 is increased. Then, the forward thrust F130 acting on the damping piston 130 becomes greater than the thrust F101 applied to the hydraulic rock drill body 101. Therefore, the damping piston 130 is advanced frontward up to the striking reference position with pushing back the chuck driver bushing 110 and the shank rod 102. Then, the forward thrust F130 acting on the damping piston 130 becomes equal to the reaction force of the thrust F101 applied to the hydraulic rock drill body 101 to stop the damping piston 130.

During this, the hydraulic rock drill body 101 is advanced for crushing length of the rock R in one strike by the feeding mechanism to contact the bit 106 onto the rock R. When the bit 106 comes in contact with the rock R, the thrust F101 of the hydraulic rock drill body 101 is transmitted from the bit 106 to the damping piston 130 as reaction force. Then, the damping piston 130 is held at a position where the frontward thrust F130 acting on the damping piston 130 becomes equal to the thrust F101 of the hydraulic rock drill body 101, namely at the striking reference position to be situated in the condition waiting next strike.

In the condition where contact between the rock R and the bit 106 is incomplete, the thrust F101 of the hydraulic rock drill body 101 is not sufficiently transmitted to the rock R. Thus, from the bit 106, the reaction force much smaller than the thrust F130 is applied to the rod 104, the sleeve 105, the chuck driver bushing 110 and the damping piston 130. At this time,the damping piston 130 is advanced frontward from the striking reference position and stops at the position where the reaction force F101 and the forward thrust F130 applied to the damping piston 130 become equal to each other. Accordingly, the damping piston 130 acts for firmly contacting the tool, such as rod 104, the bit 106 and so forth onto the rock R, namely floating function. Then, the thrust F130 acting on the damping piston 130 serves as the floating force.

In such damping mechanisms of these hydraulic rock drills, the damping piston per se performs function to urge the tool such as the bit 106 or the like onto the rock R with higher sensitivity than forward thrust acting on the hydraulic rock drill body 101, namely the damping piston 130 achieves function to firmly contact the tool onto the rock R. Therefore, it becomes necessary to adjust a damping pressure from the hydraulic power source to be applied to the damping piston similarly to a feeding pressure to be applied to the hydraulic rock drill body 101 which is adjusted by hole boring condition.

The damping mechanism shown in FIG. 9 employs the two stage damping piston.

As set forth above, the rear damping piston 112 performs damping function of the reaction energy Er, namely shock absorbing function, and the front damping piston 111 performs function to firmly contacting the tool, such as rod 104, bit 106 or the like onto the rock R, namely floating function. Then, in order to smoothly perform damping function and floating function, the floating force F111 acting on the front damping piston 111 and the damping force F112 acting on the rear damping piston 112 are set relative to the thrust F101 acting on the hydraulic rock drill body 101 to satisfy the relationship of F111<F101<F112.

However, the thrust F101 actually acting on the hydraulic rock drill body 101 is varies depending upon property of the rock R. For example, if the rock R is soft rock (fracture zone), the thrust F101 becomes low. Conversely, in the case of hard rock, the thrust F101 becomes high. This variation of thrust is referred to as Fv101.

On the other hand, since the hydraulic pressure source 116 is common, the floating force F111 and the damping force F112 can always maintain (F112/f111) or (F112–F111) constant.

Here, when the thrust Fv101 of the hydraulic rock drill body 101 is varied, the relationship between the floating force F111, the damping force F112 and the thrust Fv101 can be Fv101<F111<F112 (when the rock R is soft rock (fracture zone) or F111<F112<Fv101 (when the rock R is hard rock). When Fv101<F111<F112 is established, after contacting the bit 106 to the rock R, the front damping piston 111 is not pushed back until it comes in contact with the rear damping piston 112 to possibly cause floating failure. On the other hand, when F111<F112<Fv101 is established, since the rear damping piston 112 constantly abuts onto the rear step portion 101*b*, damping failure can be caused. Therefore, floating function and damping function becomes unsatisfactory.

On the other hand, when F111<F112<Fv101 is established, since the thrust acting on the rear damping piston 112 is smaller than the thrust of the hydraulic rock drill body 101, the shank rod 102 is retracted beyond the striking reference position. Therefore, upon striking of the shank rod 102 by the striking piston 107, the piston speed of the striking piston 107 does not become maximum to reduce striking force in spite of the fact that high striking is required essentially.

Even in the case of the floating type employing the single damper piston, the position of the damping piston 130 is varies depending upon property of the rock R. This variation of the position of the damping piston appears more significantly in the case of the floating type employing the single damping piston.

SUMMARY OF THE INVENTION

It is an object of the present invention to provide a damper pressure control apparatus for a hydraulic rock drill which is automatically adjustable of a damper pressure to be applied to a damping piston depending upon a thrust of a rock drill body for making damping function and floating function satisfactorily effective even upon occurrence of variation of thrust of the hydraulic rock drill body.

In order to accomplish the above-mentioned object, according to one aspect of the invention, in a hydraulic rock drill including:

a striking mechanism striking a tool;

a transmission member transmitting a thrust toward a crushing object to the tool;

a damping piston provided at rear side of the transmission member and damping a reaction energy from the tool and the transmission member by the frontward thrust by a damper pressure from a hydraulic pressure source; and a damper pressure control apparatus comprising damper pressure control means for controlling the damper pressure applied to the damping piston from the hydraulic pressure source on the basis of a frontward thrust acting on a hydraulic rock drill body.

The damper pressure control means automatically controls the damper pressure to be applied to the damping piston from the hydraulic pressure source on the basis of the feed pressure for the hydraulic rock drill, namely frontward thrust acting on the hydraulic rock drill. Therefore, even when the thrust of the hydraulic rock drill is varied, the damping function and the floating function of the damping piston is maintain effective.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings:

FIGS. 1A, 1B and 1C are explanatory illustrations of a hydraulic rock drill applied the present invention, wherein FIG. 1A shows a condition before hole boring into a rock by a bit, FIGS. 1B and 1C show conditions during hole boring through the rock by the bit;

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

Figure 1A:
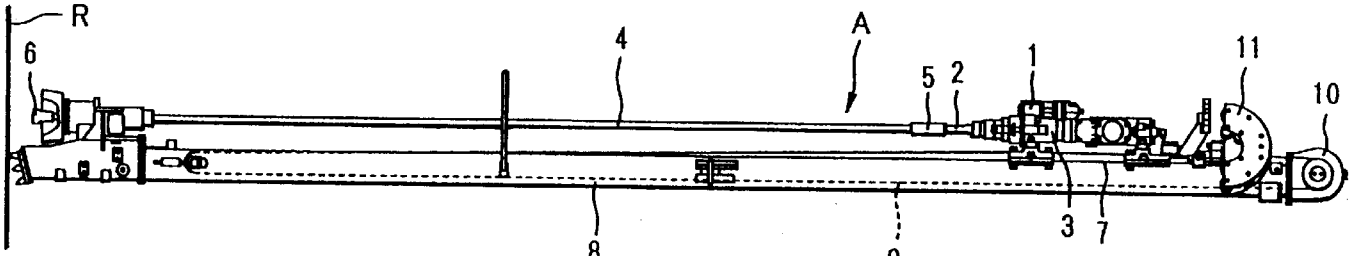
Figure 1B:
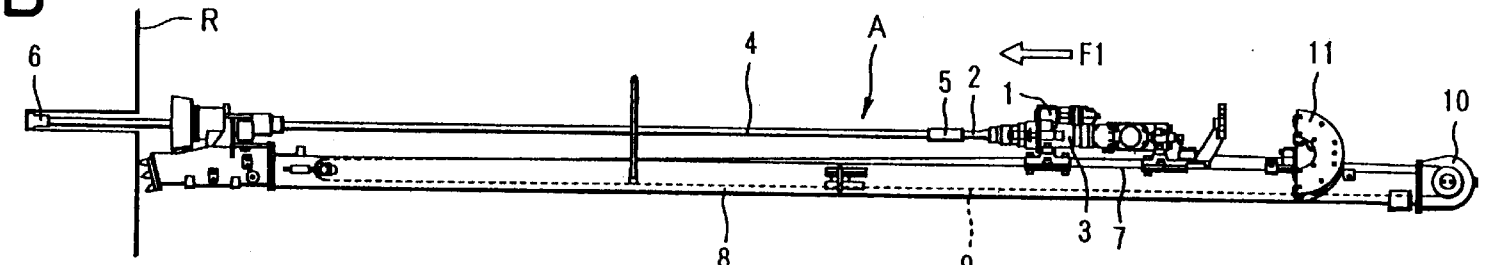
Figure 1C:
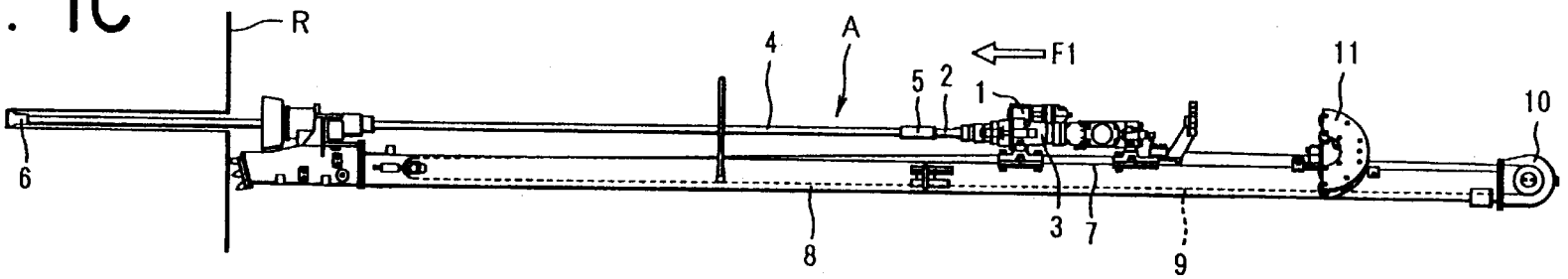
Figure 2:
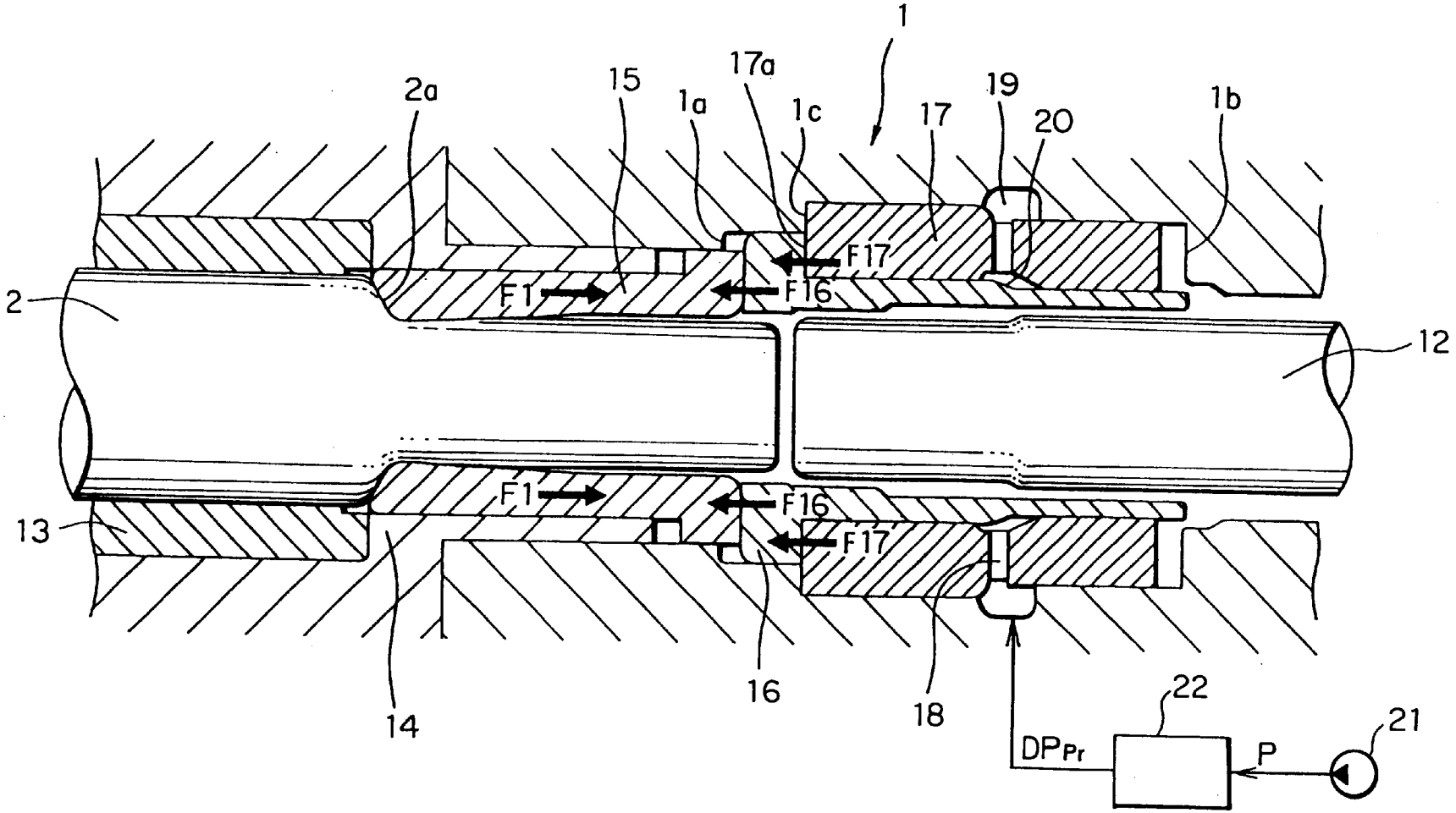
FIG. 2 is an enlarged section of a damping mechanism of the hydraulic rock drill employing a two stage damping piston showing one embodiment of the present invention.
Figure 3:
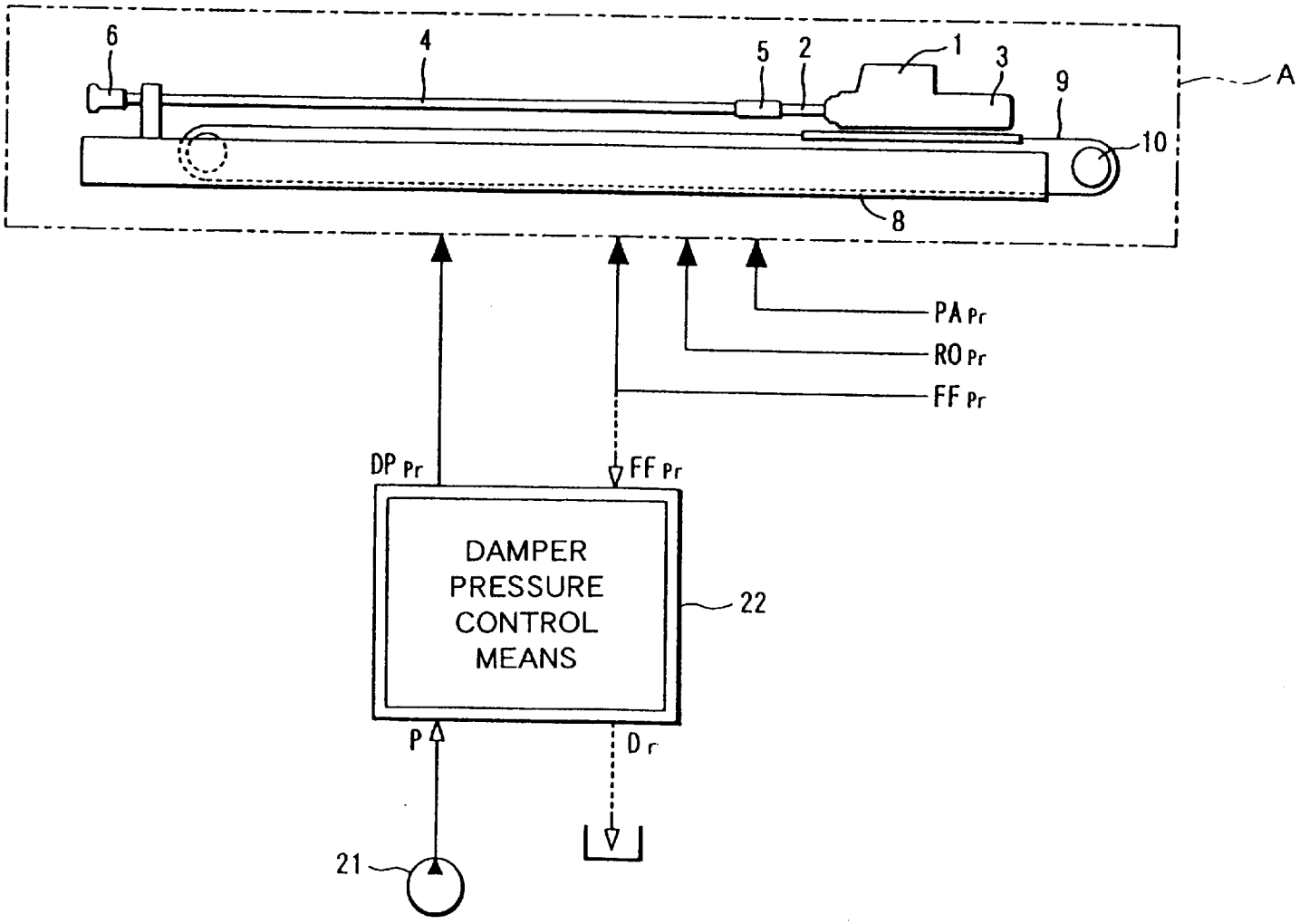
FIG. 3 is a system diagram showing the damper pressure control apparatus for the hydraulic rock drill according to the present invention.
Figure 4:
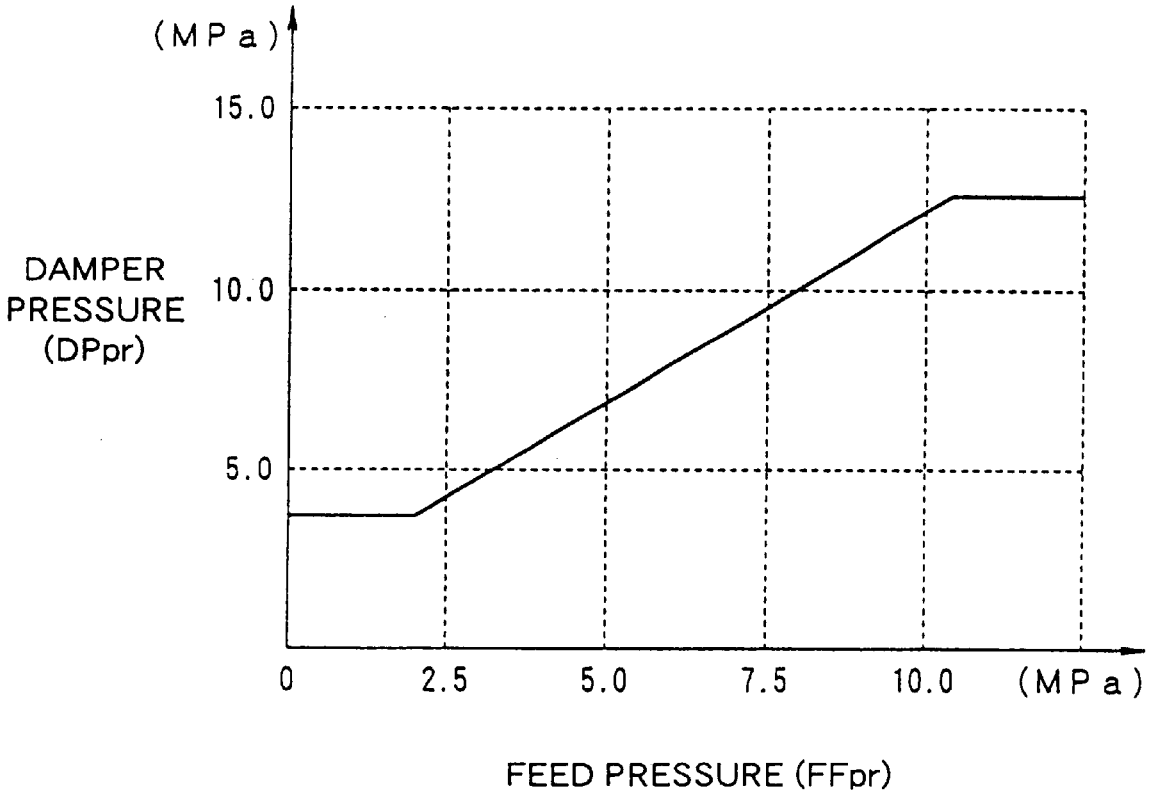
FIG. 4 is a chart showing a control characteristics showing a relationship between a damper pressure and a feeding pressure.
Figure 5:
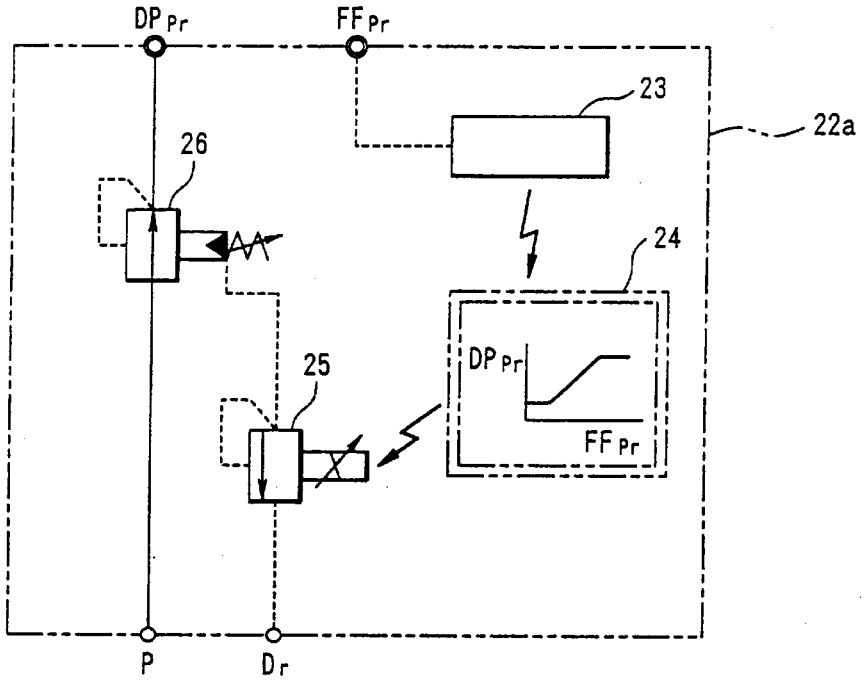
FIG. 5 is an illustration showing a construction of a damper pressure control means using an electromagnetic proportioning valve.
Figure 6:
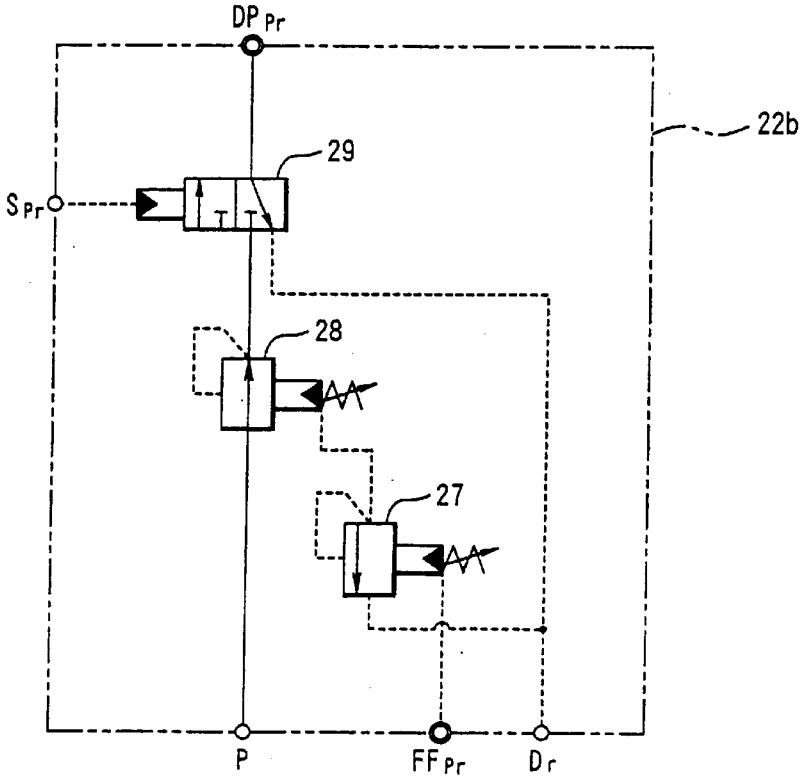
FIG. 6 is an illustration showing a construction of the damper pressure control means using a pressure adding and multiplying hydraulic control valve.

FIGS. 1A, 1B and 1C are explanatory illustrations of a hydraulic rock drill applied the present invention, wherein FIG. 1A shows a condition before hole boring into a rock by a bit, FIGS. 1B and 1C show conditions during hole boring through the rock by the bit; FIG. 2 is an enlarged section of a damping mechanism of the hydraulic rock drill employing a two stage damping piston showing one embodiment of the present invention; FIG. 3 is a system diagram showing the damper pressure control apparatus for the hydraulic rock drill according to the present invention; FIG. 4 is a chart showing a control characteristics showing a relationship between a damper pressure and a feeding pressure; FIG. 5 is an illustration showing a construction of a damper pressure control means using an electromagnetic proportioning valve; and FIG. 6 is an illustration showing a construction of the damper pressure control means using a pressure adding and multiplying hydraulic control valve.

As shown in FIG. 1, the hydraulic rock drill A has a shank rod 2 mounted at a front end portion of a rock drill body 1. A striking mechanism 3 for striking the shank rod 2 is provided at a rear side of the shank rod 2. At a front end of the shank rod 2, a rod 4 mounting a hole boring bit 6 is connected through a sleeve 5. The bit 6, the rod 4, the sleeve 5 and the shank rod 2 form a tool. The rock drill body 1 is mounted on a carriage 7 reciprocal along a guide shell 8 extending in hole boring direction. To the carriage 7, a chain 9 to be driven by a feed motor 10 is connected. On a rear side of the carriage 7, a hose reel 11 for hydraulic hose is provided.

Upon hole boring operation of the rock R, when a feed pressure is applied to the feed motor 10 from a hydraulic pressure source (not shown), the feed motor 10 is driven for revolution for driving the chain 9. To the rock drill body 1, a forward thrust F1 by the feeding force acts to move the rock drill body 1 frontward until a tip end of the bit 6 contacts with the rock R.

In the condition where the tip end of the bit 6 contacts with the rock R, the frontward thrust F1 by the feeding pressure acts on the rock drill body 1, and in conjunction therewith, the thrust F1 is transmitted to the rock drill body 1 via the bit 6, the rod 4 and the shank rod 2 as a reaction force.

At this condition, when the shank rod 2 is stricken by the striking mechanism 3, the bit 6 crushes the rock R by striking energy. Then, hole boring against the rock R is performed by rotation of the bit 6 by rotation of the shank rod 2 and the frontward thrust F1 by the feeding pressure, as shown in FIG. 1B.

Furthermore, when the shank rod 2 is stricken by the striking mechanism 3, the bit 6 further crushes the rock R by striking energy. Then, hole boring against the rock R is performed by rotation of the bit 6 by rotation of the shank rod 2 and the frontward thrust F1 by the feeding pressure, as shown in FIG. 1C.

By repeating the foregoing operation, hole boring operation against the rock R is performed.

On the other hand, in the rock drill body 1, as shown in FIG. 2, a chuck driver 14 is provided for driving the shank rod 2 via a chuck 13 to rotate. To the chuck driver 14, a chuck driver bushing 15 is provided as a transmission member contacting with a large diameter rear end 2*a* of the shank rod 2. On the rear side of the chuck driver bushing 15, a front damping piston 16 and a rear damping piston 17 as a damping mechanism are arranged.

The rear damping piston 17 is a cylindrical piston and has a fluid passage 18 communicating outside and inside thereof. The rear damping piston 17 is provided within the rock drill body 1 for sliding between a central step portion 1*c* and a rear step portion 1*b*. The rear damping piston 17 is applied a frontward damping force F17 by a hydraulic pressure in a rear damping piston fluid chamber 19, namely by a damper pressure DPpr. The damping force F17 is derived by a product of a pressure receiving area and the damper pressure DPpr in the rear damping piston fluid chamber 19.

On the other hand, the front damping piston 16 is a cylindrical piston having a large external diameter in the front end portion and a small external diameter in the rear portion. The small diameter portion of the front damping piston 16 is inserted into the rear damping piston 17 for sliding in the longitudinal direction. By the large diameter portion, the front damping piston 16 is restricted motion range in longitudinal direction between the front step portion 1*a* of the rock drill body 1 and a front end face 17*a* of the rear damping piston 17. Between an outer periphery of the small diameter portion of the front damping piston 16 and an inner periphery of the rear damping piston 17, a front damping piston fluid chamber 20 is defined. By the hydraulic pressure, namely the damper pressure DPpr, a forward floating force F16 is applied to the front damping piston 16. The floating force F16 is derived by a product of a pressure receiving area in the front damping piston fluid chamber 20 and the damper pressure DPpr.

The front damping piston fluid chamber 20 is communicated with the rear damping piston fluid chamber 19 via the fluid passage 18. The rear damping piston fluid chamber 19 is communicated with the hydraulic pressure source 21 via damper pressure control means 22.

As shown in FIG. 3, the damper pressure control means 22 is designed to control the damper pressure DPpr to be applied to the front damping piston 16 and the rear damping piston 17 on the basis of the feed pressure FFpr for feeding the rock drill body 1 frontwardly, namely the frontward thrust F1 acting on the rock drill body 1. The damper pressure control means 22 thus automatically controls a relationship between the damper pressure DPpr and the feed pressure FFpr to establish a relationship shown in FIG. 4.

Discussing more particularly, in a range of the feed pressure FFpr from 0 (Mpa) to about 2.0 (Mpa), the damper pressure DPpr is maintained constant at about 4.0 (Mpa), in a range of the feed pressure FFpr from about 2.0 (Mpa) to about 10.5 (Mpa), the damper pressure DPpr is linearly increased from about 4.0 (Mpa) to about 12.5 (Mpa) in proportion to increasing of the feed pressure FFpr. In a range of the feed pressure FFpr higher than or equal to 10.5 (Mpa), the damper pressure DPpr is maintained constant at about 12.5 (Mpa).

In a diagrammatic illustration of the damper pressure control apparatus shown in FIG. 3, to the rock drill A, a striking pressure PApr driving the striking mechanism 3, a rotational pressure ROpr driving the shank rod 2 to rotate, and a feed pressure FFpr frontwardly feeding the rock drill body 1 act. Amongst, the feed pressure FFpr is input to the damper pressure control means 22. Then, the damper pressure control means 22 controls a pump pressure P from the hydraulic pressure source 21 to the damper pressure DPpr.

As the damper pressure control means 22, a damper pressure control means 22*a* using an electromagnetic proportioning control valve shown in FIG. 5 is employed for example.

The damper pressure control means 22*a* using the electromagnetic proportional control valve shown in FIG. 5 includes a pressure sensor 23 detecting the feed pressure FFpr, an arithmetic process device 24 performing arithmetic process for establishing the relationship of the damper pressure DPpr and the feed pressure FFpr as shown in FIG. 4, an electromagnetic proportioning control valve 25 controlling a hydraulic pressure to a pressure reduction valve 26 on the basis of an electric signal from the arithmetic process device 24, and the pressure reduction valve 26 for reducing the pump pressure P to the damper pressure DPpr on the basis of the hydraulic pressure from the electromagnetic proportioning control valve 25.

Accordingly, the feed pressure FFpr frontwardly feeding the rock drill body 1 is input to the pressure sensor 23 to detect the pressure value. The pressure sensor 23 feeds the electric detection signal to the arithmetic process device 24. The arithmetic process device 24 performs pressure calculation to establish the relationship between the damper pressure DPpr and the feed pressure FFpr as shown in FIG. 4, and feeds a resultant electric signal to the electromagnetic proportioning valve 25. The electromagnetic proportioning control valve 25 controls the hydraulic pressure to the pressure reduction valve 26 on the basis of the electric signal from the arithmetic process device 24. The pressure reduction valve 26 reduces the pump pressure P to the damper pressure DPpr shown in FIG. 4 on the basis of the hydraulic pressure from the electromagnetic proportioning control valve 25. By this, the damper pressure DPpr is automatically controlled relative to the feed pressure FFpr to establish the relationship shown in FIG. 4.

Accordingly, the floating force F16 derived by the product of the damper pressure DPpr and the pressure receiving area of the front damping piston fluid chamber 20 and the damping force F17 derived by the product of the damper pressure DPpr and the pressure receiving area of the rear damping piston fluid chamber 19 are controlled to establish a predetermined relationship with the feed pressure FFpr, namely the thrust acting on the rock drill body 1. Therefore, the floating force F16 and the damping force F17 are controlled on the basis of the variable thrust Fv1 acting on the rock drill body 1 and thus become variable thrusts (Fv16, Fv17) taking the variable thrust Fv1 as parameter.

In the case of soft rock (fracture zone), the thrust Fv1 of the rock drill body 1 becomes low. Conversely, in the case of the hard rock, the thrust Fv1 becomes high. When the thrust Fv1 acting on the rock drill body 1 is low, the floating force Fv16 and the damping force Fv17 also become low as controlled on the basis of the thrust Fv1 acting on the rock drill body 1 to maintain a relationship Fv16<Fv1<Fv17. Conversely, when the thrust Fv1 acting on the rock drill body 1 is high, the floating force Fv16 and the damping force Fv17 also become high as controlled on the basis of the thrust Fv1 acting on the rock drill body 1 to maintain a relationship Fv16<Fv1<Fv17.

When the striking piston 12 of the striking mechanism 3 strikes the shank rod 2, the striking energy is transmitted from the shank rod 2 to the bit 6 through the rod 4. Then, the bit 6 strikes the rock R as crushing object. At this time, a reaction energy from the rock R is transmitted to the front damping piston 16 and the rear damping piston 17 via the rod 4, the shank rod 2 and chuck driver bushing 15. The rear damping piston 17 is retracted as being damped by the damping force Fv17 together with the front damping piston 16 until the rear end face abuts onto the rear step portion 1*b* to transmit the reaction energy to the rock drill body 1.

At this time, the damping force Fv17 is controlled to constantly maintain the relationship of Fv1<Fv17 relative to the thrust Fv1 on the rock drill body 1. Thus, damping action of the rear damping piston 17 is satisfactorily effective. Thus, the reaction energy to be transmitted from the shank rod 2 to the chuck driver bushing 15 is damped by retraction of the rear damping piston 17, damage on the rock drill body 1, the bit 6, the rod 4 and the shank rod 2 can be satisfactorily small.

By the reaction energy transmitted to the rock drill body 1, the rock drill body 1 is once retracted backward. However, thereafter, since the damping force Fv17 is greater than the thrust Fv1 to be applied to the rock drill body 1, the rear damping piston 17 pushes back the front damping piston 16, the chuck driver bushing 15 and the shank rod 2 and stops at the striking reference position where the front end face 17*a* abuts onto the central step portion 1*c* of the rock drill body 1. At this condition, the next strike is awaited.

As set forth, since the floating force Fv16 and the damping force Fv17 is constantly maintained a relationship of Fv16<Fv1<Fv17 relative to the thrust Fv1 of the rock drill body 1, the front damping piston 16 and the rear damping piston 17 comes in contact at the striking reference position as shown in FIG. 2 at each striking cycle. Therefore, upon striking the shank rod 2 by the striking piston 12, a piston speed of the striking piston 12 becomes maximum so that the striking force is not reduced.

In the condition where contact between the bit 6 and the rock R is incomplete, the thrust Fv1 of the rock drill body 1 is not transmitted sufficiently to the rock R. Therefore, from the bit 6, a reaction force much smaller than the thrust Fv1 is transmitted to the rod 4, the sleeve 5, the shank rod 2, the chuck driver bushing 15 and the front damping piston 16.

At this time, the floating force Fv16 is smaller than the thrust Fv1 of the rock drill body 1 but greater than the foregoing reaction force, the front damping piston 16 is moved away from the rear damping piston 17 to push the chuck driver bushing 15 and the shank rod 2 until bit 6 contacts with the rock R more quickly than advancing of the rock drill body 1 to prevent blank striking.

Subsequently, the rock drill body 1 is advanced by the thrust Fv1. The floating force Fv16 maintains the relationship of Fv16<Fv1 relative to the thrust Fv1 of the rock drill body 1. Therefore, after contacting the bit 6 onto the rock R, the front damping piston 16 is certainly pushed backwardly until it comes in contact with the rear damping piston 17 by a reaction force of the thrust Fv1. Accordingly, the floating action is smoothly performed.

It should be noted that, as the damper pressure control means 22, a damper pressure control means 22*b* using a pressure adding and multiplying hydraulic control valve shown in FIG. 6, may be employed, for example. The damping pressure control means 22*b* includes a first pressure reduction valve 27 controlling a hydraulic pressure to a second pressure reduction valve 28 on the basis of the feed pressure FFpr, the second pressure reduction valve 28 reducing a pump pressure P to the damper pressure DPpr on the basis of the hydraulic pressure from the first pressure reduction valve 27, and a pilot operation switching valve 29 provided on reduced pressure outlet side of the second pressure reduction valve 28 and switching between the drain Dr side and the second pressure reduction valve 28 side. The pilot operation switching valve 29 is normally communicated the drain Dr side to the rear damping piston fluid chamber 19 side. When an operation signal pressure Spr is acted by operation of the rock drill A, the spool valve is switched to establish communication of the second pressure reduction valve 28 side to the rear damping piston fluid chamber 19 side.

The damping mechanism of the hydraulic drill according to the present invention should not be limited to shown construction but can be modified in various ways.

For example, the damper pressure DPpr establishes a relationship with the feed pressure FFpr as shown in FIG. 4. However, the relationship shown in FIG. 4 is not essential but any relationship which constantly satisfied the relationship between the floating force Fv16, the damping force Fv17 and the thrust of Fv16<Fv1<Fv17.

Figure 7:
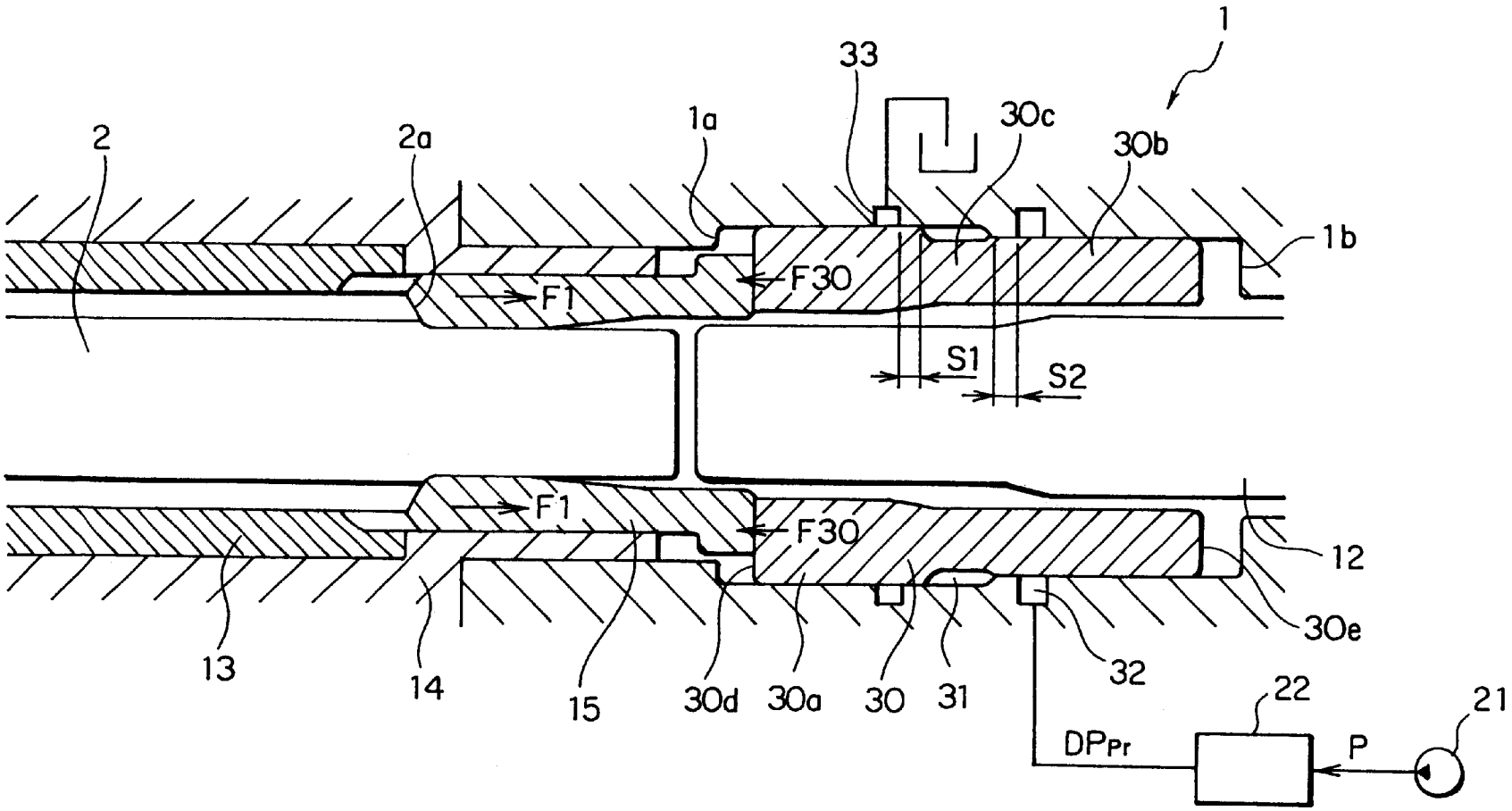
FIG. 7 is an enlarged section of the damper mechanism of the hydraulic rock drill employing a single damping piston as another embodiment of the present invention.
Figure 8:
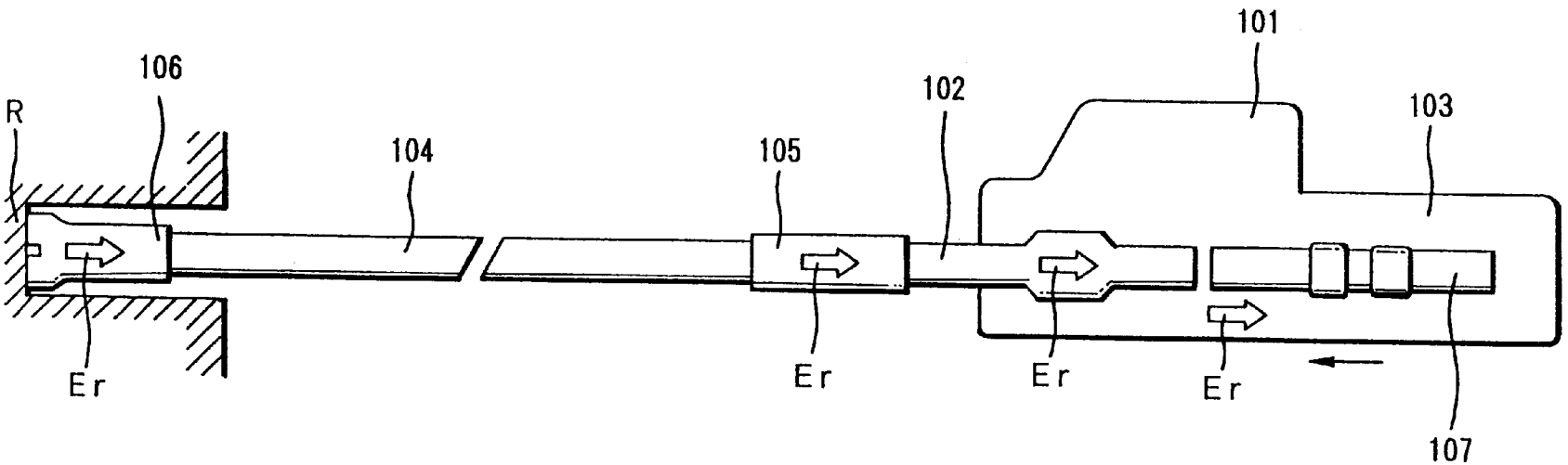
FIG. 8 is a general illustration showing a basic construction of the conventional hydraulic rock drill.
Figure 9:
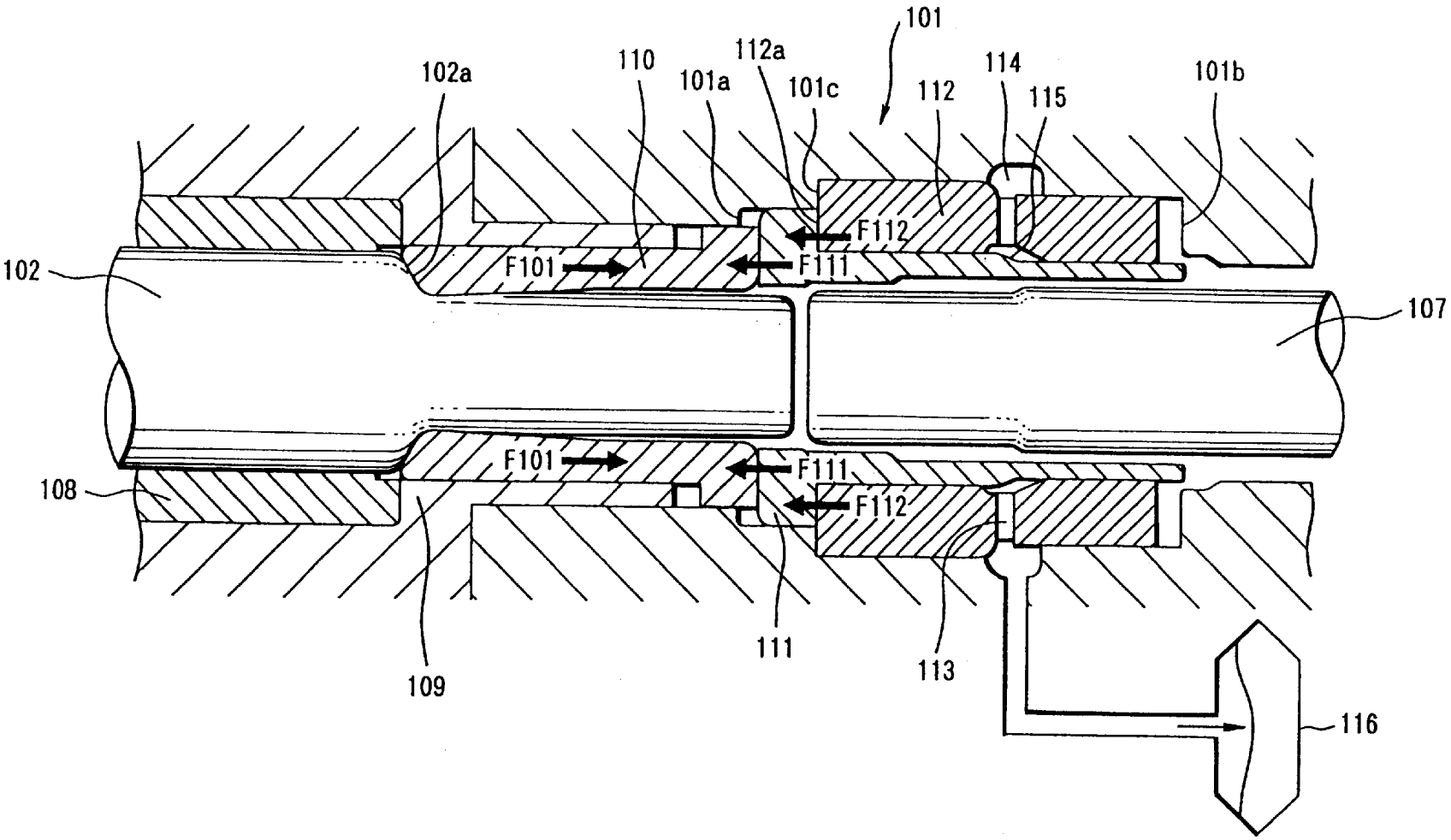
FIG. 9 is an enlarged section of the damping mechanism of the hydraulic rock drill using the conventional two stage type damping piston.
Figure 10:
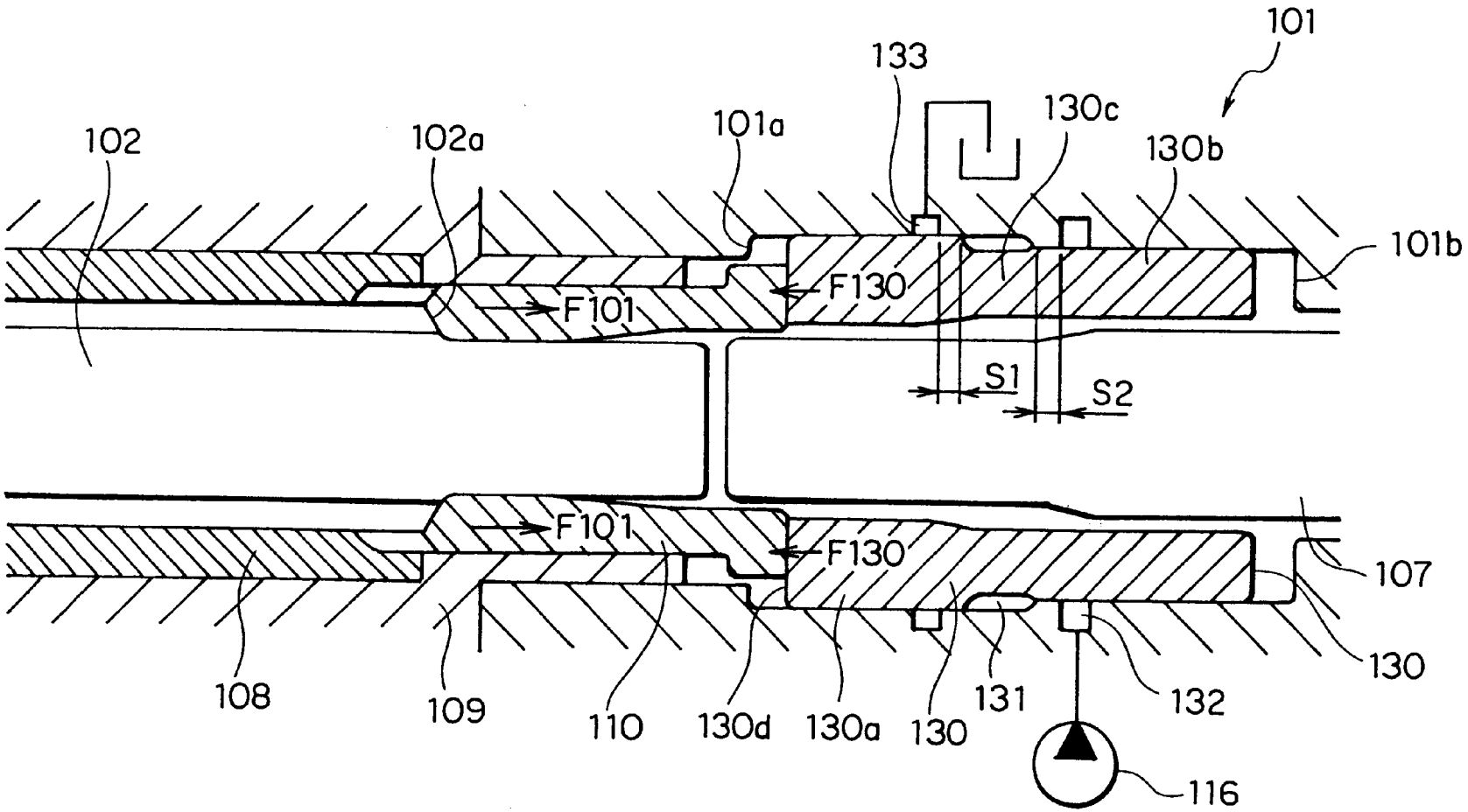
FIG. 10 is an enlarged section of the damping mechanism using the conventional single damping piston.

On the other hand, FIG. 7 is an enlarged section of a damping mechanism of a hydraulic rock drill using a single damping piston shown in another embodiment of the present invention.

As shown in FIG. 7, the rock drill body 1 has the chuck driver 14 applying rotation for the shank rod 2 via the chuck 13. To the chuck driver 14, the chuck driver bushing 15 is mounted as the transmission member contacting with the large diameter rear end 2*a* of the shank rod 2. On the rear side of the chuck driver bushing 15, a damping piston 30 forming the damping mechanism is provided.

The damping piston 30 is a cylindrical piston having a large diameter portion 30*a* at front side and a small diameter portion 30*b* at rear side. A neck portion 30*c* having smaller external diameter than the small diameter portion 30*b* is provided between the large diameter portion 30*a* and the small diameter portion 30*b*. Then, the damping piston 30 is installed within the rock drill body 1 for sliding movement in longitudinal direction between the front step portion 1*a* and the rear step portion 1*b*.

Between an inner peripheral sliding surface of the rock drill body 1 and the neck portion 30*c* of the damping piston 30, a hydraulic pressure chamber 31 is defined. The damping piston 30 is applied a frontward thrust by a hydraulic pressure in the hydraulic pressure chamber 31. Then, on the inner peripheral sliding surface of the hydraulic rock drill body 1, a drain passage 33 is defined at the front side of the hydraulic pressure chamber 31 at a position distant from the latter for a seal length S1, and a pressure supply passage 32 is defined at the rear side of the hydraulic pressure chamber 31 at a position distant from the latter for a seal length S2. The pressure supply passage 32 is communicated with a hydraulic pressure source 21 via the damper pressure control means 22.

As the damper pressure control means 22, one having similar construction as those shown in FIGS. 5 and 6 may be employed. The damping pressure DPpr applied to the pressure supply passage 32 of the damping piston 30 is controlled on the basis of the feed pressure FFpr feeding the rock drill body 1 frontwardly, namely the frontward thrust F1.

The pressurized fluid from the hydraulic pressure source 21 flows into the hydraulic pressure chamber 31 via the damper pressure control means 22, the pressure supply passage 32 and the seal length S2 and is discharged to the drain passage 33 via the seal length S1. At this time, a pressure P31 corresponding to a difference of inflow amount and discharge amount of the pressurized fluid is generated in the hydraulic pressure chamber 31. The pressure P31 of the hydraulic pressure chamber 31 is smaller than the hydraulic pressure DPpr from the damper pressure control means 22, P31<DPpr.

The thrust F30 applied to the damping piston 30 is a product of the pressure receiving area of the hydraulic pressure chamber 31 and the pressure P31. At a condition where the damping piston 30 stops at the striking reference position (position shown in FIG. 7), the thrust F30 applied to the rock drill body 1 becomes equal to F1, namely F30) =F1.

When the damping piston 30 is retracted from the striking reference position, the seal length S2 is reduced to increase flow amount of the pressurized fluid flowing into the hydraulic pressure chamber 31 from the hydraulic pressure source 21 via the damper pressure control means 22 and the pressure supply passage 32, and conversely, the seal length S1 is increased to reduce flow amount of the pressurized fluid from the hydraulic pressure chamber 31 to the drain passage 33. By this, the hydraulic pressure P31 in the hydraulic pressure chamber 31 is increased to increase frontward thrust F30 applied to the damping piston 30.

Furthermore, when the damping piston 30 is driven backward to contact the rear end face 30*e* of the damping piston 30 onto the rear step portion 1*b*, the seal length S2 becomes smaller than or equal to 0. Then, all amount of the pressurized fluid from the damper pressure control means 22 flows into the hydraulic pressure chamber 31, and conversely, the seal length S1 is further increased to further reduce pressurized fluid flowing out to the drain passage 33. By this, the hydraulic pressure P31 in the hydraulic pressure chamber 31 is further increased. Therefore, forward thrust F30 to be applied to the damping piston 30 becomes maximum.

On the other hand, when the damping piston 30 is advanced from the striking reference position, the seal length S2 is increased to reduce the flow amount of the pressurized fluid flowing into the hydraulic pressure chamber 31 from the hydraulic pressure source 21 via the damper pressure control means 22 and the pressure supply passage 32, and conversely, the seal length S1 is reduced to increase flow amount flowing out from the hydraulic pressure chamber 31 to the drain passage 33. By this, the hydraulic pressure P31 in the hydraulic pressure chamber 31 is reduced to reduce the frontward thrust F30 to be applied to the damping piston 30.

When the damping piston 30 is further advanced to contact the front end face 30*d* onto the front step portion 1*a*, the seal length S1 becomes smaller than or equal to 0. Then, the hydraulic pressure chamber 31 and the drain passage 33 are communicated to further reduce the hydraulic pressure P31 in the hydraulic pressure chamber 31. Therefore, the forward thrust F30 to be applied to the damping piston 30 becomes minimum.

The damper pressure DPpr to be applied to the pressure supply passage 32 of the damping piston 30 is controlled to establish a predetermined relationship with the feed pressure FFpr, namely the thrust F1 acting on the rock drill body 1. Therefore, the thrust F30 of the damping piston 30 is controlled on the basis of the variable thrust Fv1 acting on the rock drill 1 to be a variable thrust Fv30 taking the variable thrust Fv1 as a parameter.

The thrust Fv1 of the rock drill acting on the rock drill body 1 becomes low when the rock R is soft rock. Therefore, the thrust Fv30 of the damping piston 30 also becomes low on the basis of the thrust Fv1 acting on the rock drill body 1. Therefore, a relationship Fv1=Fv30 is maintained.

The thrust Fv1 of the rock drill acting on the rock drill body becomes high when the rock R is hard rock. Therefore, the thrust Fv30 of the damping piston 30 also becomes high on the basis of the thrust Fv1 acting on the rock drill body 1. Therefore, a relationship Fv1=Fv30 is maintained.

When the striking piston 12 strikes the shank rod 2 at the striking reference position, the striking energy is transmitted to the bit 6 from the shank rod 2 via the rod 4. Then, the bit 6 strikes and crushes the rock R as crushing object. At this time, an impulsive reaction energy Er from the rock R is transmitted from the bit 6 to the damping piston 30 via the rod 4, the shank rod 2 and the chuck driver bushing 15. Then, the damping piston 30 is retracted with damping the reaction energy Er by the hydraulic pressure in the hydraulic pressure chamber 31 to transmit the reaction energy Er to the rock drill body 1.

Accordingly, the damping piston 30 performs damping action of the reaction energy Er, namely impact absorbing function. Then the thrust Fv30 acting on the damping piston 30 serves as the damping force.

The rock drill body 1 is retracted by the reaction energy Er transmitted thereto once. Subsequently, reaction force against strike is reduced. Then, reaction force to act on the chuck driver bushing 15 becomes only reaction force of the thrust Fv1 applied to the rock drill body 1. On the other hand, associating with retraction of the damping piston 30, the hydraulic pressure P31 in the hydraulic pressure chamber 31 is increased to make the frontward thrust Fv30 acting on the damping piston 30 become greater than the reaction force of the thrust Fv1 applied to the rock drill body 1. Therefore, the damping piston 30 pushes back the chuck driver bushing 15 and the shank rod 2 to up to the striking reference position. Then, the frontward thrust Fv30 acting on the damping piston 30 becomes equal to the reaction force of the thrust Fv1 applied to the rock drill body 1 to stop the damping piston 30.

During this period, the rock drill body 1 is advanced for the crushing length of the rock R for one strike by the feeding mechanism to contact the bit 6 onto the rock R. When the bit 6 contacts with the rock R, the thrust Fv1 of the rock drill body 1 is transmitted to the damping piston 30 as the reaction force from the bit 6. The damping piston 30 is maintained at a position where the frontward thrust Fv30 becomes equal to the thrust Fv1 of the rock drill body 1, namely at the striking reference position to wait for next strike. Accordingly, the thrust Fv30 acting on the damping piston 30 serves as floating thrust.

As set forth above, with the damper pressure control apparatus of the hydraulic rock drill according to the present invention, since the damper pressure control means controlling the damper pressure applied from the hydraulic pressure source to the damping piston, is provided, the damper pressure to be applied to the damping piston can be automatically adjustable by the damper pressure control means depending upon the thrust of the rock drill body so that the floating action and damping action of the damping piston can be satisfactorily effective even when the thrust of the hydraulic rock drill is varied.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. In a hydraulic rock drill including:

a striking mechanism striking a tool;

a transmission member transmitting a thrust toward a crushing object to said tool;

a damping piston provided at rear side of said transmission member and damping a reaction energy from said tool and said transmission member by said frontward thrust by a damper pressure from a hydraulic pressure source; and a damper pressure control apparatus comprising damper pressure control means for controlling said damper pressure applied to said damping piston from said hydraulic pressure source on the basis of a frontward thrust acting on a hydraulic rock drill.

* * * * *